US007329145B2

(12) United States Patent
Yagome et al.

(10) Patent No.: US 7,329,145 B2
(45) Date of Patent: Feb. 12, 2008

(54) STRUCTURE FOR ATTACHING GASKET

(75) Inventors: Sachiko Yagome, Shizuoka-ken (JP); Hajime Katou, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/636,651

(22) Filed: Dec. 11, 2006

(65) Prior Publication Data

US 2007/0184701 A1 Aug. 9, 2007

(30) Foreign Application Priority Data

Feb. 3, 2006 (JP) ..... P2006-027544

(51) Int. Cl.
*H01R 13/73* (2006.01)

(52) U.S. Cl. ..... 439/556; 439/271

(58) Field of Classification Search ..... 439/271, 439/548, 556, 559

See application file for complete search history.

(56) References Cited

U.S. PATENT DOCUMENTS 5,158,391 A * 10/1992 Fujitani et al. ..... 403/288
5,622,512 A * 4/1997 Uchida et al. ..... 439/271
5,779,493 A * 7/1998 Tomita et al. ..... 439/271
6,422,899 B1 * 7/2002 Miyazaki ..... 439/559
6,814,599 B2 * 11/2004 Sakiyama et al. ..... 439/271
6,953,357 B2 * 10/2005 Fukushima et al. ..... 439/271

FOREIGN PATENT DOCUMENTS

JP 2004-327169 11/2004

* cited by examiner

*Primary Examiner*—Thanh-Tam Le
(74) *Attorney, Agent, or Firm*—Finnegan, Henderson, Farabow, Garrett & Dunner, L.L.P.

(57) ABSTRACT

A gasket of an elastic material is housed in a ring-shaped groove formed on the front face of a flange of a connector housing. By bringing the front face into contact with a contact face of a mating member, the space between the mating member and the flange of the connector housing is sealed with the gasket. An L-shaped locking arm is provided on the outer periphery of the ring-shaped gasket to be housed in the ring-shaped groove. The locking arm juts out sideward along the front face of the flange, and then is bent backward leaving the front face. A T-shaped hook is integrally provided to the tip of the locking arm. A receiving portion with a locking slot is provided in a side portion of the flange. The locking arm is engaged, by its own elasticity, with the locking slot, and the hook is engaged with the back face of the receiving portion.

3 Claims, 6 Drawing Sheets

1
10
16
50
15
14
11
12
13
35
34
31
32
32a
30

STRUCTURE FOR ATTACHING GASKET

BACKGROUND OF THE INVENTION

1. Field of the Invention

The present invention relates to a structure for attaching a gasket, which is applied to a panel-mounted connector or the like.

2. Description of the Related Art

There is a type of connector that is mounted on a panel, or a panel-mounted connector for short. In general, the type of connector is actually mounted on a panel in the following way. A gasket made of an elastic material is housed in a ring-shaped groove provided in the front face of a flange of a connector housing. The gasket is interposed between and compressed by the flange and the peripheries of an opening, which is formed in the panel in order to mount the connector.

When the connector is actually mounted on the panel to make this kind of panel-mounted connector, the gasket sometimes falls off the flange. For this reason, some measures have been taken in many cases to deal with the problem of this falling off as being disclosed in Japanese Patent Application Laid-open Official Gazette No. 2004-327169.

FIGS. 1 and 2 show one example of such measures.

A panel-mounted connector of the example comprises a connector housing 110; unillustrated terminal metal fittings housed inside the connector housing 110; and a gasket 130 housed in a ring-shaped groove 112 formed in the front face of a flange 111 of the connector housing 110.

The gasket 130 includes a ring-shaped gasket body 131 housed in the ring-shaped groove 112 of the flange 111; locking jutting pieces 132 each including a through-hole 132*a*; and locking arms 134 each including a locking stub 134*a*. The locking jutting pieces 132 are provided as jutting out of the inner periphery of the gasket body 131. The locking arms 134 are provided as jutting out of the outer periphery of the gasket body 131. The gasket 130 is fixed to the flange 111 in the following manner. The gasket body 131 is fitted to the ring-shaped groove 112 of the flange 111. The through-holes 132*a* of the locking jutting pieces 132 are fitted respectively to locking pins 116, which are provided as jutting out of the flange 111 at inner positions than the ring-shaped groove 112. The locking stubs 134*a* of the locking arms 134 are fitted respectively to locking holes 114*a* of respective receiving portions 114, each provided on a side portion of the flange 111.

SUMMARY OF THE INVENTION

However, the above panel-mounted connector of the related art has a problem of decreased efficiency in operations for attaching the gasket. In the panel-mounted connector, the locking arms 134 each including the locking stub 134*a* are respectively provided to the portions on the outer periphery of the gasket. The locking stubs 134*a* are fitted respectively to the locking holes 114*a* provided to the corresponding receiving portions 114 on the corresponding side portions of the flange 111. A careful checking of the position of the locking holes 114*a* is needed to fit the tips of the locking stubs 134*a* to the corresponding locking holes 114*a*; This results in the problem of the efficiency.

The present invention has been made to solve such a problem of the related art as described above. An object of the present invention is to provide a structure for attaching a gasket, which enables easier operations for engaging the gasket with the flange, the engagement being useful in order to prevent the gasket from falling off the flange.

The scope of a first aspect of the present invention to achieve the above-described object is a structure for attaching a gasket, which has the following characteristics. The structure for attaching a gasket includes a member to which a gasket is attached (attaching member), a mating member and an elastic gasket. The attaching member includes a first flange. In the front face of the first flange, a ring-shaped groove is formed. A receiving portion with a locking slot is formed on a side portion of the first flange. The mating member includes a contact face to be brought in contact with the front face of the first flange. The gasket is housed in the ring-shaped groove, and a space between the first flange and the mating member of the attaching member is sealed with the gasket. In the structure for attaching a gasket, the gasket includes a ring-shaped gasket body housed in the ring-shaped groove; a locking arm provided on the outer periphery of the gasket body; and a hook portion integrally formed on the tip of the locking arm. The locking arm is engaged, by use of its own elasticity, with the locking slot from a side of the flange, and the hook portion is engaged with the back face of the receiving portion.

According to the first aspect of the present invention, the locking arm is fitted, by use of its own elasticity, to the locking slot of the receiving portion, provided to a side portion of the flange, from a side of the flange. Only by the fitting of the locking arms from the side, a T-shaped hook (hook portion) on the tip of the locking arm can be engaged with the back face of the receiving portion. Accordingly, it is possible, with ease, to prevent the gasket from falling off the flange, thereby improving the efficiency in the operations for attaching the gasket.

The locking arm may have an L-shape, as the locking arm juts out sideward along the front face of the first flange, and is then bent backward leaving the front face of the first flange. The hook portion may have a T-shape.

Since the T-shaped hook is engaged with the back surface of the receiving portion from a side of the flange in the above-described structure, the gasket can be prevented from being unstable. Hence, excellent sealing performance of the gasket can be ensured. Since the L-shaped locking arm is bent backward, there is no concern that the gasket may be incorrectly attached on the flange back to front. Hence, it is possible to preclude an incorrect attaching of the gasket that may otherwise happen sometimes.

The structure for attaching a gasket may further include a cover member which covers the attaching member from the back thereof, and which includes a second flange with a recess, which is in the front face of the second flange. The first flange is fitted to the recess so that the receiving portion, the locking arm, and the hook portion are housed in a portion of the recess. The hook portion may be interposed between and compressed by the attaching member and the cover member.

In the above-described structure, the locking arm and the like are housed in the portion of the recess of the cover member, and thus the hook of the gasket is interposed between and compressed by the attaching member and the cover member. Accordingly, there is no concern that another member may get stack on, or may interfere with the locking arm or the hook, to cause the hook to fall off the receiving portion. Hence, it is possible to surely prevent the falling off of the gasket 30.

The gasket may include a locking jutting piece which is integrally formed on the inner periphery of the gasket body, and which has a through-hole. The through-hole may be fitted to a locking pin which is provided as jutting out of the flange at an inner position than the ring-shaped groove.

In the above-described structure, the locking jutting piece is provided on the inner periphery of the gasket body, and the through-hole provided to the locking jutting piece is fitted to the locking pin. The locking pin is provided as jutting out of the flange at the inner position than the ring-shaped groove. Accordingly, the inner and the outer peripheries of the gasket body can be fixed in order to prevent the gasket from falling off from the flange. Thereby, it is made possible to surely prevent the falling off of the gasket, and hence appropriate sealing performance of the gasket can be realized.

DESCRIPTION OF THE PREFERRED EMBODIMENT

Figure 1:
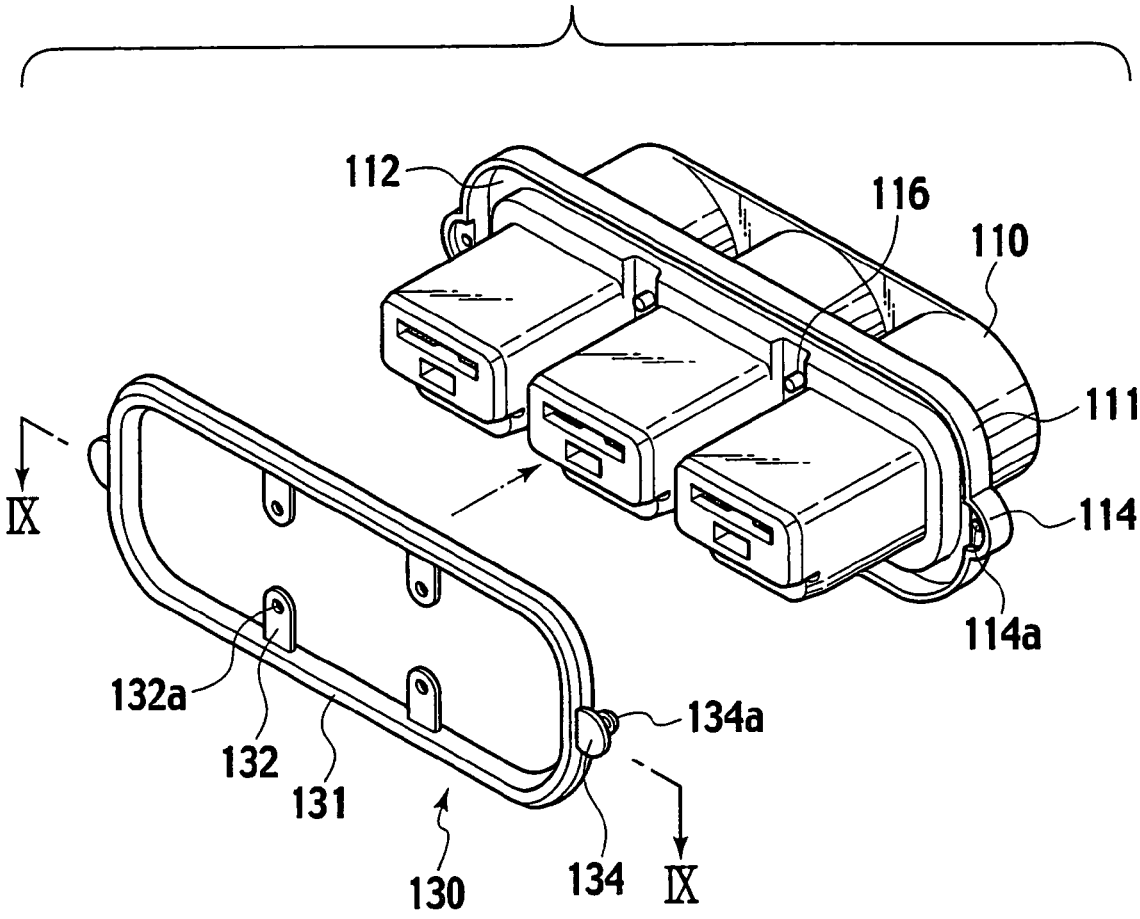
FIG. 1 PRIOR ART
FIG. 1 is an exploded perspective view of a panel-mounted connector of a related art.
Figure 2:
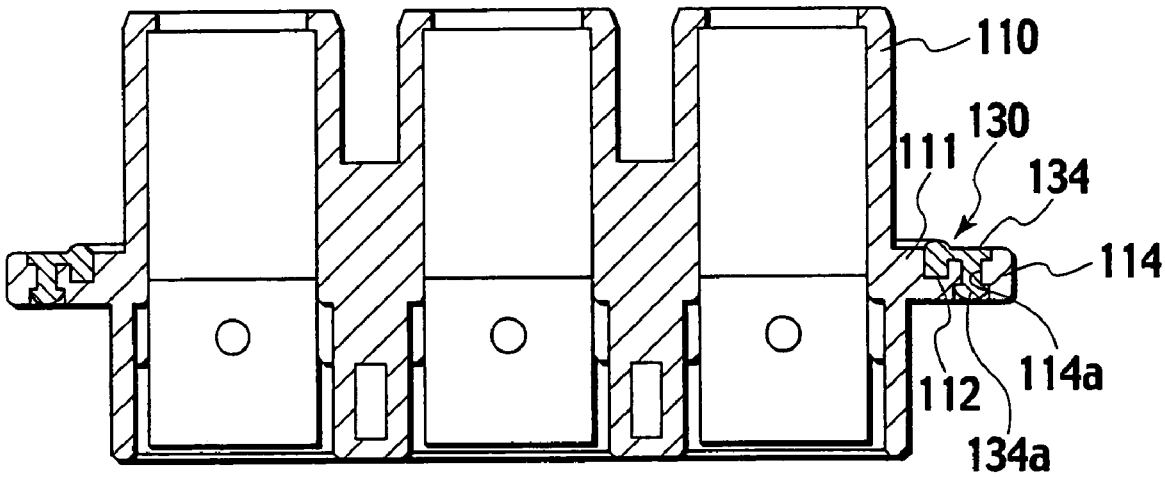
FIG. 2 PRIOR ART
FIG. 2 is a cross-sectional view of the panel-mounted connector of FIG. 1, taken along and seen as indicated by the double arrowed line IX-IX of FIG. 1.

By referring to the drawings, descriptions will be provided for an embodiment in which the present invention is applied to a panel-mounted connector. In the following descriptions of the drawings, identical portions are denoted by the same reference numerals, and portions similar to each other are denoted by similar reference numerals. The drawings, however, are schematic. For this reason, note that the relations between the thickness and the surface dimension, the ratio of the thicknesses of the respective layers, and the like, are not real ones.

Figure 3:
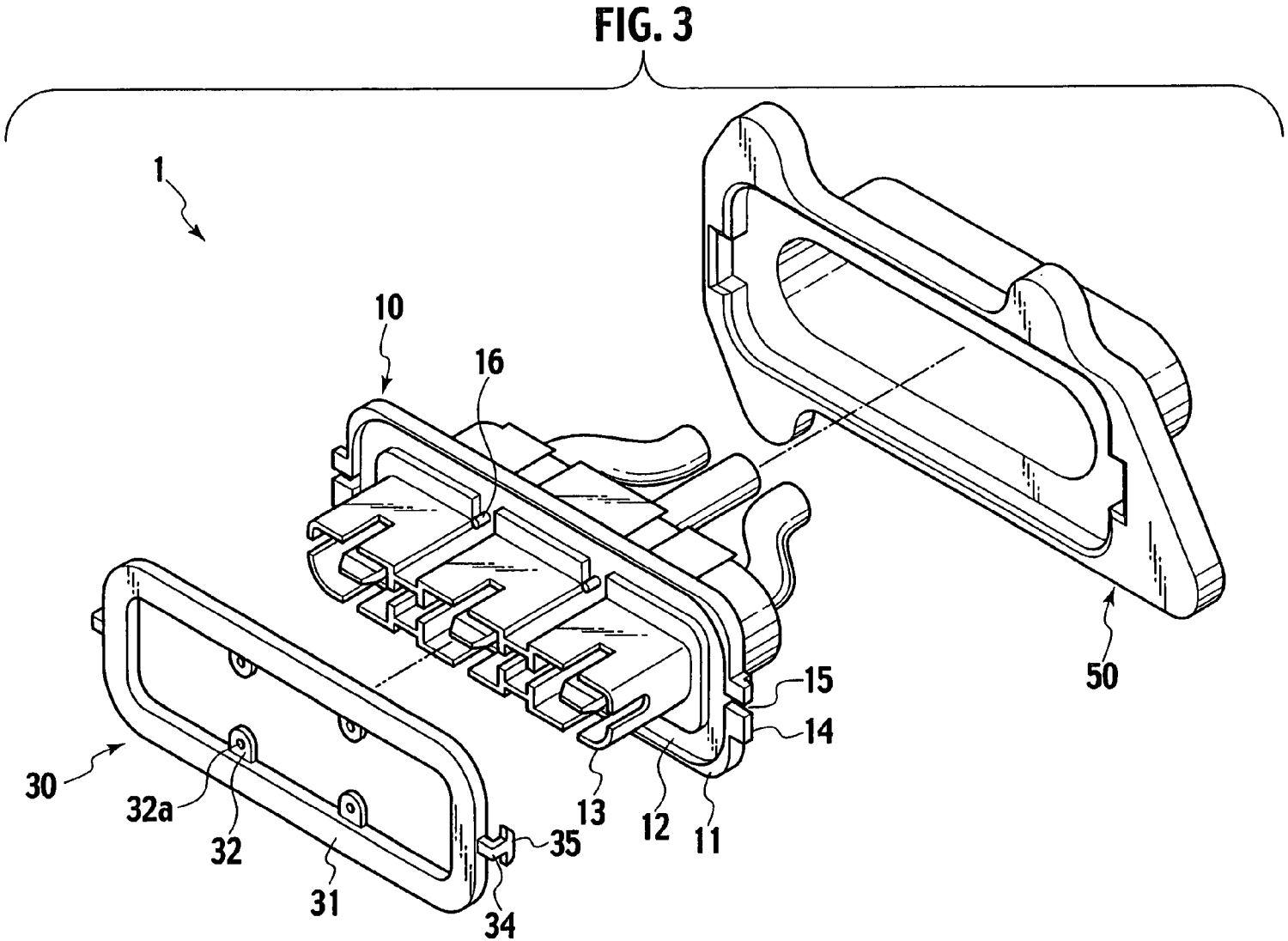
FIG. 3 is an exploded perspective view of a structure for attaching a gasket of an embodiment of the present invention.
Figure 4:
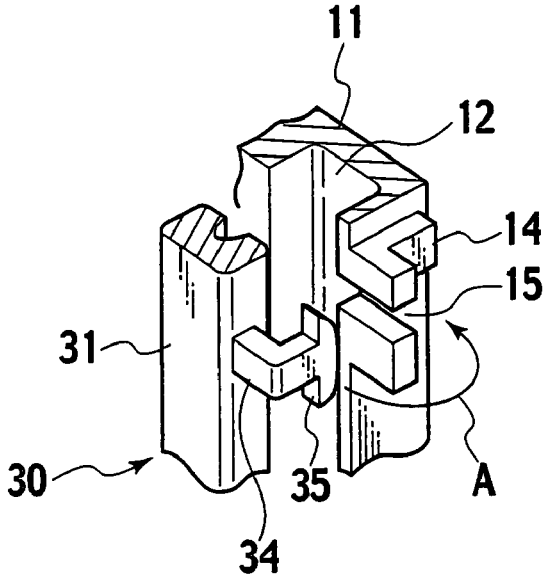
FIG. 4 is an enlarged exploded perspective view of an essential part of the structure for attaching a gasket of the embodiment of the present invention.
Figure 5:
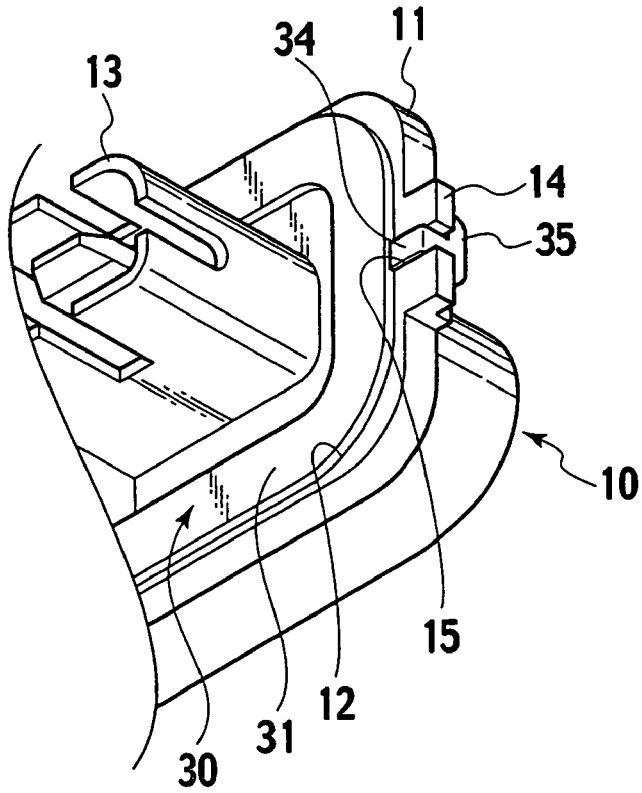
FIG. 5 is a perspective view of an essential part, showing an assembled state of the structure for attaching a gasket of the embodiment of the present invention.
Figure 6:
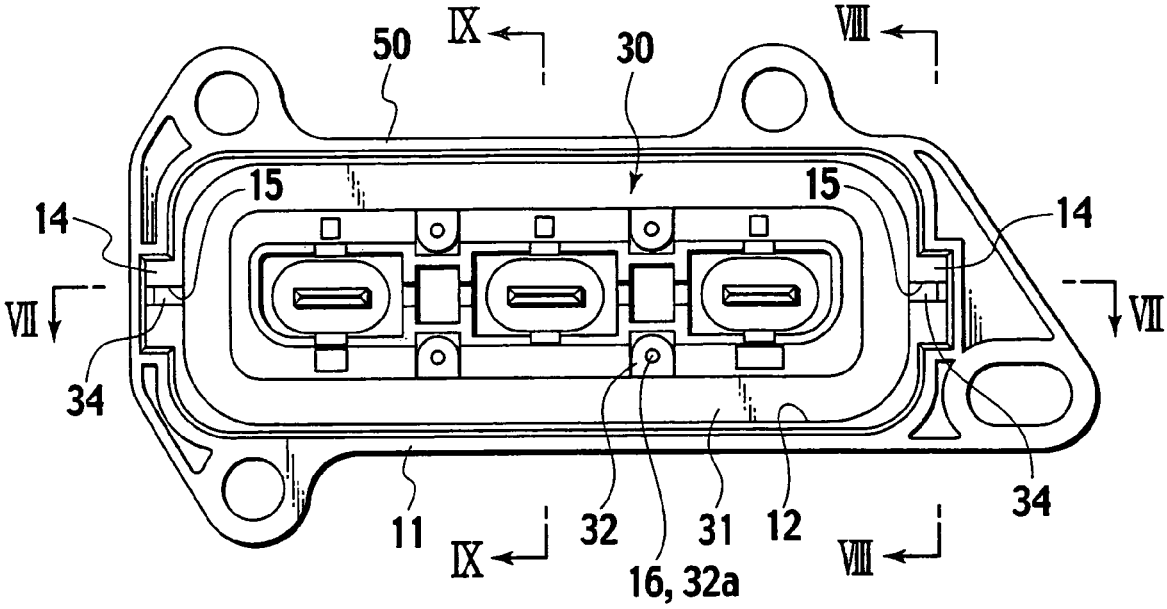
FIG. 6 is a front view showing the assembled state of the structure for attaching a gasket of the embodiment of the present invention.
Figure 7:
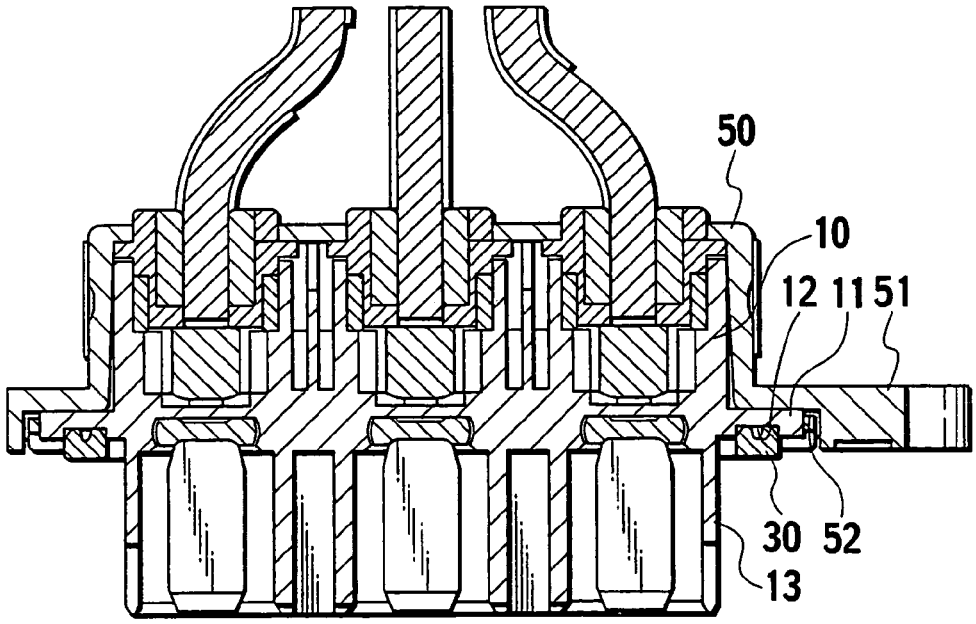
FIG. 7 is a cross-sectional view of the structure for attaching a gasket of FIG. 6, taken along and seen as indicated by the double-arrowed line V-V of FIG. 6.
Figure 8:
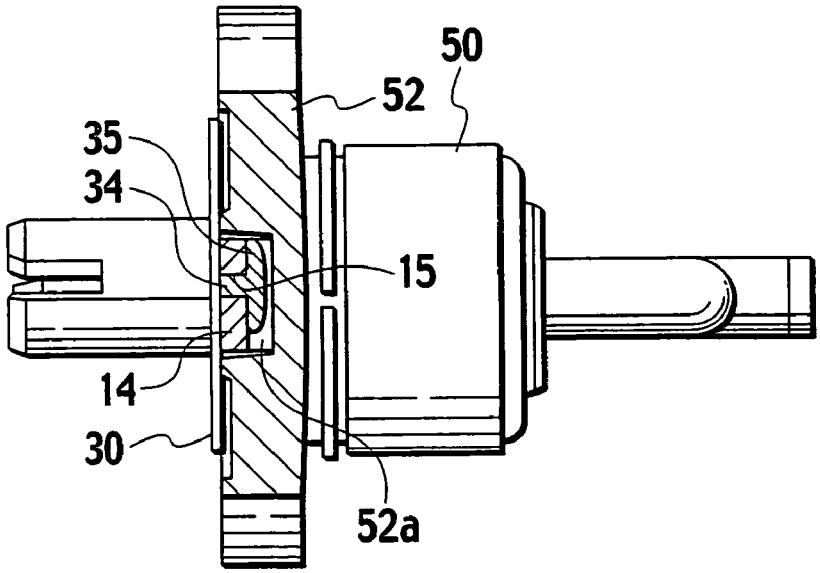
FIG. 8 is a cross-sectional view of the structure for attaching a gasket of FIG. 6, taken along and seen as indicated by the double-arrowed line VI-VI of FIG. 6.
Figure 9:
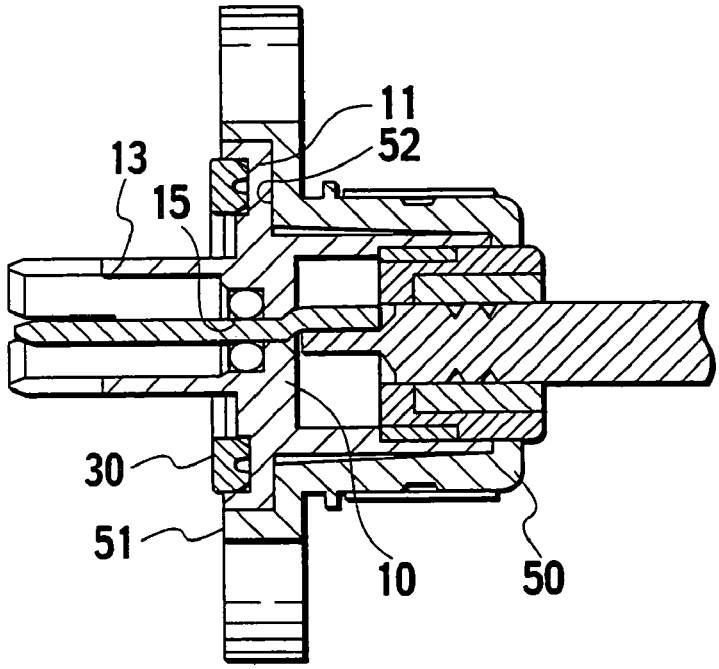
FIG. 9 is a cross-sectional view of the structure for attaching a gasket of FIG. 6, taken along and seen as indicated by the double-arrowed line VII-VII of FIG. 6.

FIG. 3 is an exploded perspective view of the panel-mounted connector of the embodiment of the present invention. FIG. 4 is an enlarged exploded perspective view of an essential part of the panel-mounted connector of the embodiment of the present invention. FIG. 5 is a perspective view of an essential part, showing the assembled state of the panel-mounted connector of the embodiment of the present invention. FIG. 6 is a front view showing the assembled state of the panel-mounted connector of the embodiment of the present invention. FIG. 7 is a cross-sectional view of the panel-mounted connector of FIG. 6, taken along and seen as indicated by the double-arrowed line V-V of FIG. 6. FIG. 8 is a cross-sectional view of the panel-mounted connector of FIG. 6, taken along and seen as indicated by the double-arrowed line VI-VI of FIG. 6. FIG. 9 is a cross-sectional view of the panel-mounted connector of FIG. 6, taken along and seen as indicated by the double-arrowed line VII-VII of FIG. 6.

The panel-mounted connector 1 (hereinafter, simply referred to as "connector 1") of the embodiment of the present invention is mounted on a shield wall equivalent to a panel in order to shield terminal metal fittings. As illustrated, the connector 1 includes a connector housing (mounting member) 10 made of insulating resin; terminal metal fittings (not illustrated) fitted to the connector housing 10; a gasket 30 fitted to a ring-shaped groove 12 of a flange 11 of the connector housing 10; and a diecast aluminum cover (cover member) 50, covering the connector housing 10 from the back. A plurality of hood portions 13 are provided in a front portion of the connector housing 10, and the terminal metal fittings are disposed respectively in the hood portions 13.

The ring-shaped groove 12 is formed in the front face of the flange 11 in a way that the ring-shaped groove surrounds all of the hood portions 13. The front face of the flange 11 is to be brought into contact with a contact face of the shield wall (not illustrated) serving as a mating member. The gasket 30 made of an elastic material (for instance, made of rubber) is housed in the ring-shaped groove 12, and thus the space between the shield wall (not illustrated) and the flange 11 is sealed with the gasket 30.

The gasket 30 includes a ring-shaped gasket body 31 housed in the ring-shaped groove 12. L-shaped locking arms 34 are integrally provided respectively to side portions on the outer periphery of the gasket body 31. The locking arms 34 jut out of the gasket body 30 sideward along the front face of the flange 11, and are then bent backward leaving the front face of the flange 11. A T-shaped hook (hook portion) 35 is integrally provided to the tip of each of the locking arms 34. As shown by the arrow A of FIG. 4, each locking arm 34 is engaged with a locking slot 15 of each receiving portion 14 from a side of the flange 11 by use of the elasticity of the very locking arm 34. Each receiving portion 14 is provided to a side portion of the flange 11. The T-shaped hook 35 is engaged respectively with the back surface of each receiving portion 14. Thereby, the outer periphery of the gasket 30 is fixed so that the flange 11 would be prevented from falling off the flange 11.

A plurality of locking jutting pieces 32 are integrally provided on the inner periphery of the gasket body 31. Through-holes **32*a* are provided respectively, to the locking jutting pieces 32. Locking pins 16 are provided as jutting out of the flange 11 at inner positions than the ring-shaped groove 12. The through-holes 32*a* are fitted to the respective locking pins 16. Thereby, the inner periphery of the gasket 30 is fixed so that the flange 11 would be prevented from falling off the flange 11**.

As illustrated in FIGS. 7 and 9, the flange 11 of the connector housing 10 is fitted to a recess 52 of the front face of a flange 51 of the aluminum cover 50. Accordingly, as illustrated in FIG. 8, a set of the receiving portion 14 of the connector housing 10, the locking arm 34, and the hook 35 of the gasket 30 is housed in a portion **52*a* of the corresponding recess 52. In addition, the hooks 35 of the gasket 30 are fixed as the hooks 35 are interposed between and compressed by the connector housing 10 and the cover 50**.

In the structure described above in which the gasket 30 is attached to the flange 11, the locking arms 34 are provided to the outer periphery of the gasket 30, and the receiving portions 14, each with the locking slot 15, are provided to the side portions of the flange 11 of the connector housing 10. In the structure described above, each of the locking arms 34 is fitted to the corresponding one of the locking slots 15 from a side of the flange 11. Only by the fitting of the locking arms 34, each of the T-shaped hooks 35 of the respective tips of the locking arms 34 can be engaged with the corresponding one of the back faces of the receiving portions 14. In this manner, the engaging operations to prevent the gasket 30 from falling off the flange 11 can be easily carried out. Thereby, the efficiency in the operations for the attaching of the gasket 30 can be improved.

The T-shaped hooks 35 are engaged respectively with the back surfaces of the receiving portions 14 from a side of the flange 11. As a result, the gasket 30 can be prevented from being unstable, and excellent sealing performance of the gasket can be ensured.

Since the L-shaped locking arms 34 face back, there is no concern that the gasket may be incorrectly attached to the flange back to front. Hence, it is possible to preclude an incorrect attaching of the gasket 30 that may otherwise happen sometimes.

The locking jutting pieces 32 are provided on the inner periphery of the gasket body 31, and the through-holes 32*a* are provided respectively to the locking jutting pieces 32. The locking pins 16 are provided as jutting out of the flange 11 of the gasket body 31 at inner positions than the ring-shaped groove 12. The through-holes 32*a* are fitted to the corresponding locking pins 16. Thanks to this fitting, it is possible to fix the inner and outer peripheries of the gasket body 31 so that the gasket 30 would be prevented from being falling off the flange 11. Thereby, the prevention of the falling off of the gasket 30 is ensured, and hence appropriate sealing performance of the gasket can be realized.

The hooks 35 of the gasket 30 are interposed between and compressed by the connector housing 10 and the cover 50, in a state where each of the locking arms 34 and the like are housed in the portion 52*a* of the recess 52 of the cover 50. Accordingly, there is no concern that another member may get stuck on, or may interfere with the locking arms 34 or with the hooks 35, to cause the hooks 35 to fall off the receiving portions 14. Hence, the gasket 30 can be surely prevented from falling off the flange 11.

The descriptions have been provided for the present invention by use of the embodiment. However, the present invention is not limited to the embodiment. The numbers of such members as the locking arm and the locking pin are not limited to the numbers described in the embodiment. It is possible to replace the configuration of each part with an arbitrary configuration realizing functions similar to those of the embodiment.

What is claimed is:

1. A structure for attaching a gasket comprising:

an attaching member including a first flange which has a ring-shaped groove formed in a front face of the first flange, and which has a receiving portion with a locking slot formed on a side portion of the first flange;

an elastic gasket housed in the ring-shaped groove, including a ring-shaped gasket body housed in the ring-shaped groove; a locking arm provided on an outer periphery of the gasket body; and a hook portion integrally formed on a tip of the locking arm, and a cover member which covers the attaching member from the back, and which includes a second flange having a recess in a front face of the second flange, wherein the first flange is fitted to the recess so that the receiving portion, the locking arm and the hook portion are housed in a portion of the recess, and that the hook portion is interposed between the attaching member and the cover member; and the locking arm is engaged with the locking slot from a side of the first flange by use of the elasticity of the locking arm, and the hook portion is engaged with a back face of the receiving portion.

2. The structure for attaching a gasket as recited in claim 1, wherein the locking arm has an L-shape, in which the locking arm extends sideward along a front face of the first flange, and is then bent backward leaving the front face of the first flange, and the hook portion has a T-shape.

3. The structure for attaching a gasket as recited in claim 1, wherein the gasket includes a locking jutting piece having a through-hole, the locking jutting piece being integrally formed on an inner periphery of the gasket body, and the through-hole is configured to accept a locking pin which protrudes from the flange at a position farther inside than the ring-shaped groove.

* * * * *